US007264504B2

(12) United States Patent
Lappöhn

(10) Patent No.: US 7,264,504 B2
(45) Date of Patent: Sep. 4, 2007

(54) FEMALE MULTIPLE CONNECTOR FOR ELECTRICAL PLUG-TYPE CONNECTORS

(75) Inventor: Jürgen Lappöhn, Gammelshausen (DE)

(73) Assignee: ERNI Elektroapparate GmbH, Adelberg (DE)

( * ) Notice: Subject to any disclaimer, the term of this patent is extended or adjusted under 35 U.S.C. 154(b) by 0 days.

(21) Appl. No.: 11/268,817

(22) Filed: Nov. 8, 2005

(65) Prior Publication Data

US 2006/0110981 A1 May 25, 2006

(30) Foreign Application Priority Data

Nov. 9, 2004 (DE) ..... 10 2004 054 003

(51) Int. Cl.
*H01R 13/40* (2006.01)

(52) U.S. Cl. ..... 439/595; 439/79; 439/744

(58) Field of Classification Search ..... 439/595, 439/79, 80, 608, 744, 746
See application file for complete search history.

(56) References Cited

U.S. PATENT DOCUMENTS

| | | | | |
|---|---|---|---|---|
| RE28,147 | E * | 9/1974 | Hoffman | 439/595 |
| 5,380,220 | A * | 1/1995 | Okabe | 439/456 |
| 5,934,927 | A * | 8/1999 | Nagai | 439/397 |
| 6,471,549 | B1 | 10/2002 | Lappöhn | 439/608 |

FOREIGN PATENT DOCUMENTS

| | | |
|---|---|---|
| WO | WO 01/29931 | 4/2001 |

* cited by examiner

*Primary Examiner*—Javaid H. Nasri
(74) *Attorney, Agent, or Firm*—Collard & Roe, P.C.

(57) ABSTRACT

A female multipole connector for electric plug-type connectors, particularly for weak current, having contact springs accommodated in guide channels of a plate-shaped basic body, so as not to become loose. The contact springs are directly, mechanically, and rigidly connected with the basic body.

11 Claims, 6 Drawing Sheets

Detail B

FEMALE MULTIPLE CONNECTOR FOR ELECTRICAL PLUG-TYPE CONNECTORS

CROSS REFERENCE TO RELATED APPLICATIONS

Applicant claims priority under 35 U.S.C. §119 of GERMAN Application No. 10 2004 054 003.9 filed on Nov. 9, 2004.

BACKGROUND OF THE INVENTION

1. Field of the Invention

The invention relates to a female multipole connector for electric plug-type connectors, particularly for weak current, in which contact springs are accommodated in guide channels of a plate-shaped basic body, so as not to come loose.

2. The Prior Art

Plug-type connectors are known, in which multipole female connectors are plugged into multipole plugs, particularly in multiple rows, in a quiver-like manner. The female multipole connectors and multipole plugs have contact elements that correspond to one another.

These plug-type connectors connect electronic components or modules with one another, preferably for releasably connecting circuit boards with one another. In the case of such a plug-type connector described in International Application No. WO 01/29931 A1, the female multipole connectors consist of plate-like basic bodies made of insulating material, into which guide channels that lie next to one another and extend lengthwise are worked. During the assembly process of the female multipole connectors, contact springs in the shape of conductive tracks are inserted into these guide channels. The contact springs are punched from sheet material for springs, in one piece, and bent. They usually carry the actual, mostly two-arm contact spring for contacting with a contact blade on one end of the conductive track, and a solder connection at the other end of the conductive track. The contact springs that have been laid into place are secured by means of a planar cover plate that is set onto the plate-shaped basic body. The inside of the cover plate also has guide channels, which interact with the guide channels in the basic body in such a manner that the raised ribs of the cover plate engage into the recessed guide channels of the basic body. In this manner, contact springs that have been laid into the recessed guide channels of the basic body are mechanically fixed in place. Furthermore, the basic body has small tabs, distributed over its surface, which correspond with small holes in the cover plate. In this manner, the cover plate can be set onto the basic body, fitted with components, with a non-positive lock and a positive lock.

The cover plate is part of the production costs, particularly the material costs and the assembly costs, and increases the thickness of the female multipole connector.

SUMMARY OF THE INVENTION

It is therefore an object of the invention to provide a female multipole connector for plug-type connectors in which the production costs can be lowered, and the thickness of the female multipole connectors can be reduced, while meeting the same mechanical and electrical requirements.

This task is accomplished, according to the invention, by means of a female multipole connector in which the contact springs are directly, mechanically, and rigidly connected with the basic body, in other words without ancillary components.

According to a first embodiment, the contact springs are directly connected with the basic body with an elastic positive lock. According to a variant of the elastic positive lock, the contact springs are mechanically, rigidly connected with the basic body by means of a direct snap connection. For this purpose, snap-in contours for the contact springs are molded into the guide channels, according to a preferred embodiment. It is advantageous if the side walls of the guide channels possess projections having snap-in slants, behind which the contact springs snap in, at intervals. The projections can be disposed either on one side or both sides, distributed over the length of the guide channels. The placement of pairs of snap-in projections on both sides has proven to be particularly advantageous. Furthermore, at least one passage, in each instance, is provided in the bottom of the basic body of the female multipole connector, in the region of the snap-in projections on the side walls of the guide channels, to improve the spring-elastic behavior of the said body segments of the side walls. The passages are preferably disposed under each snap-in projection. It is also advantageous that the lengthwise expanse of a passage is greater than the lengthwise expanse of a snap-in projection. According to another embodiment, a passage is disposed under the end regions of each snap-in projection.

For problem-free snapping in during the joining process, the contact springs have such spring properties, in the section of the conductive track, that they deform elastically when they are pressed behind the projections of the guide channels, and spring back elastically again behind the projections when the end position has been reached.

According to another embodiment of the invention, the contact springs themselves carry catch projections that elastically snap in behind corresponding bottom-side undercuts in the guide channels.

According to a another embodiment of the invention, a plastic positive lock takes place between the contact springs and the basic body.

In a preferred embodiment of the plastic positive lock, a tab connection of the contact springs on the back of the basic body is provided. The tabs are inserted through passages in the basic body and bent around against the bottom of the basic body. According to another variant, cross-set extenders attached to the contact springs are set crosswise.

According to another embodiment, the contact springs are fixed in place in the basic body by thermally partially plasticized side walls, or attached by thermal riveting using pins that project upward out of the basic body, which pins pass through passages in the conductive tracks of the spring contacts.

The advantages of the invention consist, in particular, in the fact that an additional cover plate is no longer required for attaching the spring contacts in the basic body, thereby reducing the production expenditure. Since the plug-type connectors being considered are produced in large numbers, a correspondingly great economic advantage can be achieved.

BRIEF DESCRIPTION OF THE DRAWINGS

Other objects and features of the present invention will become apparent from the following detailed description considered in connection with the accompanying drawings.

It is to be understood, however, that the drawings are designed as an illustration only and not as a definition of the limits of the invention.

In the drawings, wherein similar reference characters denote similar elements throughout the several views:

FIG. 1 shows a female multipole connector according to the invention, in a top view;

Figure 1:
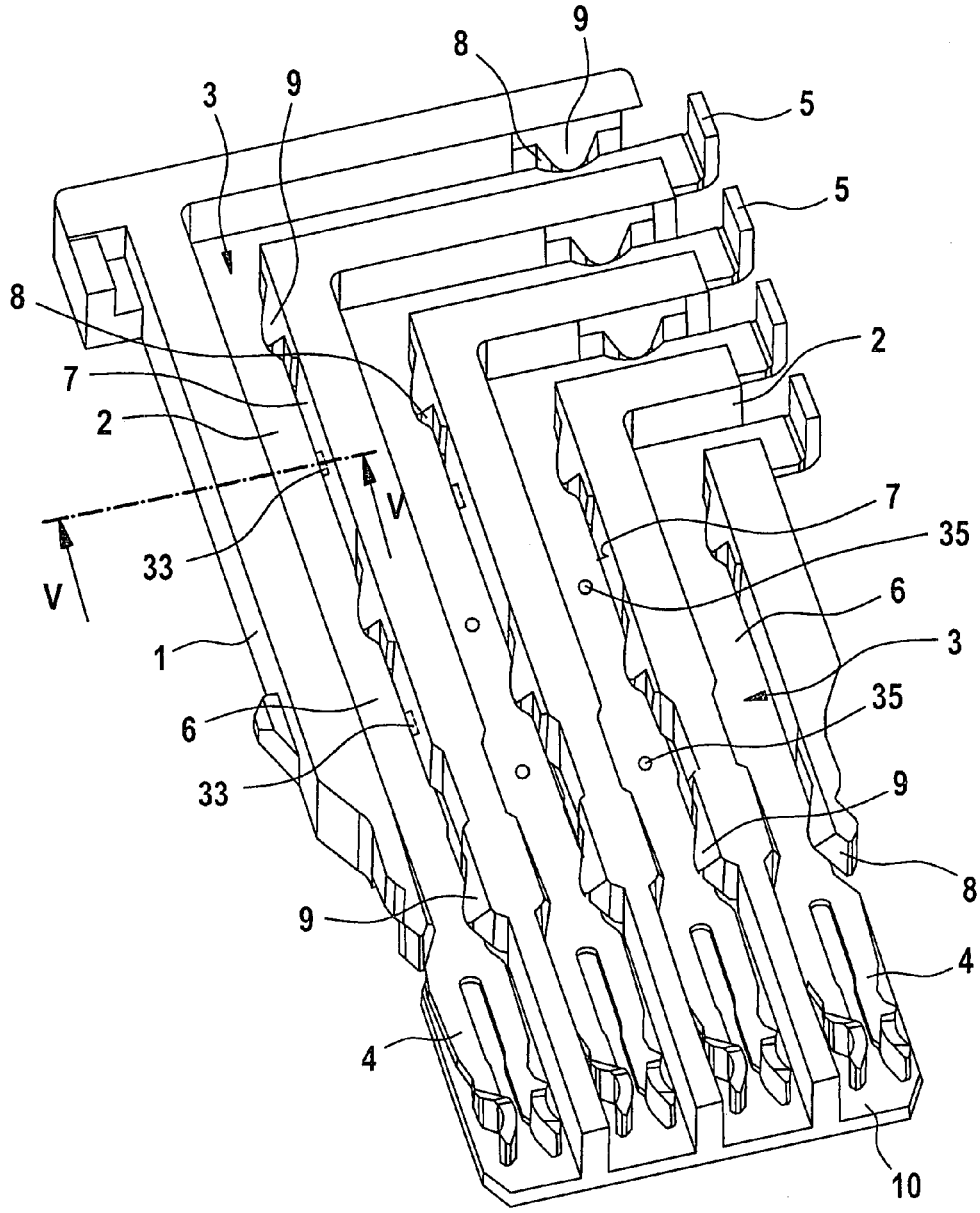
Figure 1A:
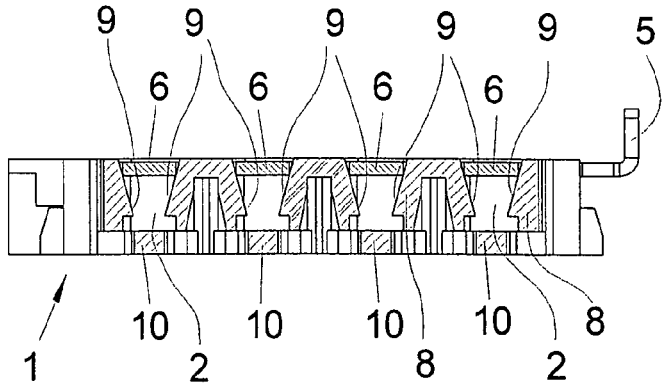
Figure 1B:
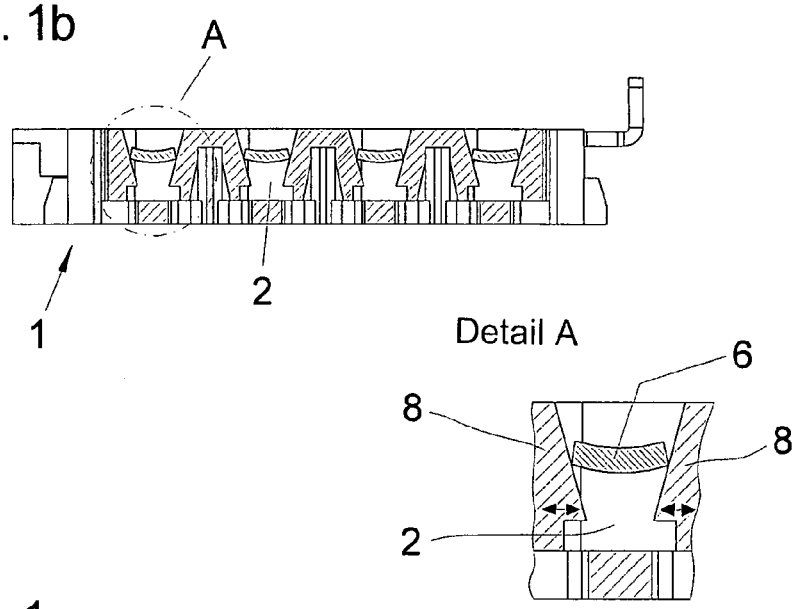
Figure 1C:
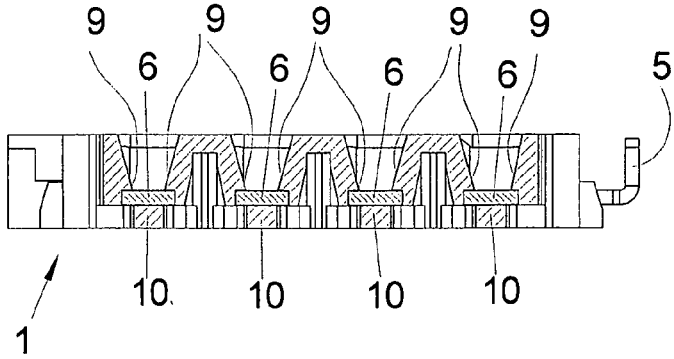

FIGS. 1*a*, 1*b*, and 1*c* show cross-sectional views of the female multipole connector shown in FIG. 1 showing contact springs with spring properties in a section of conductive track such that the contact springs deform elastically when pressed behind snap-in projections of guide channels and spring back elastically again upon reaching an end position by snapping in behind the snap-in projections.

Figure 2:
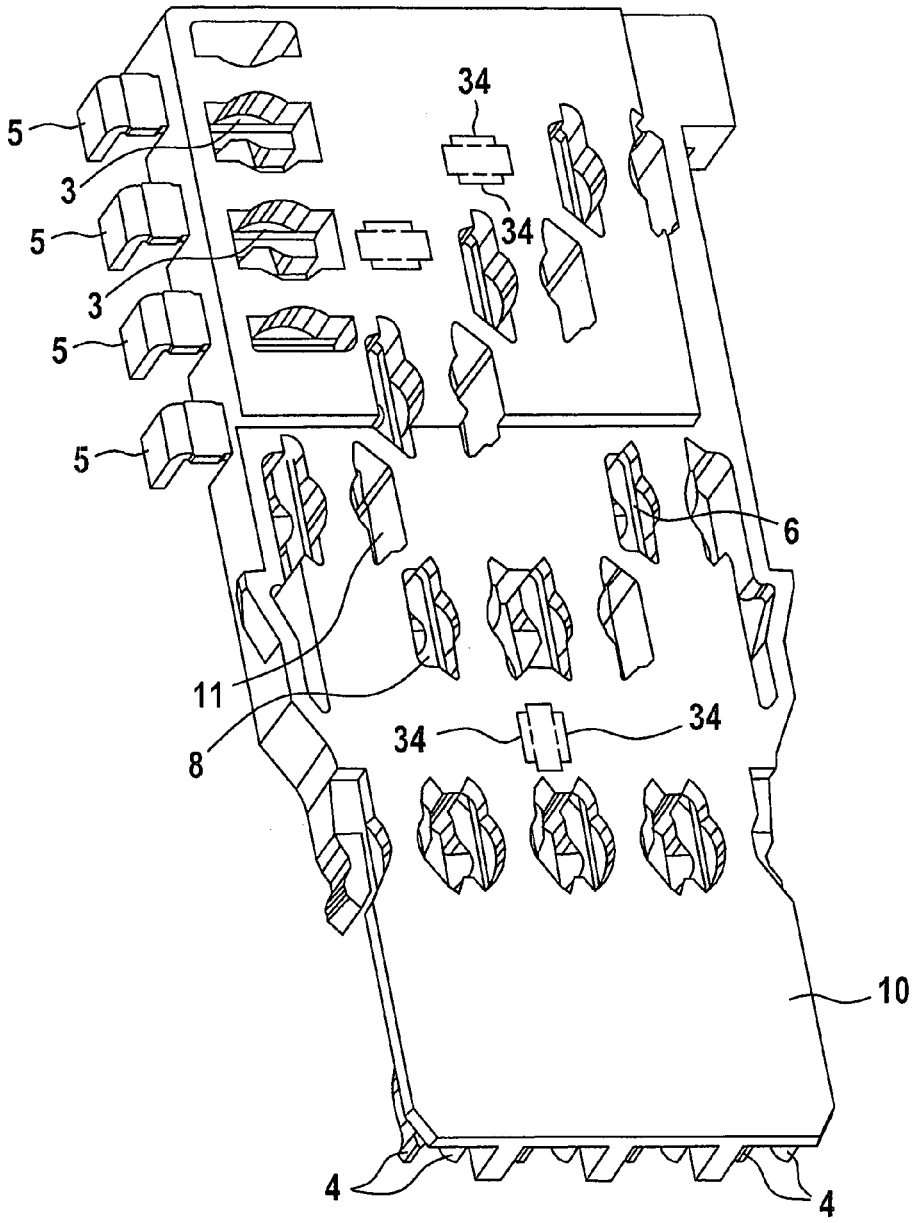
Figure 3:
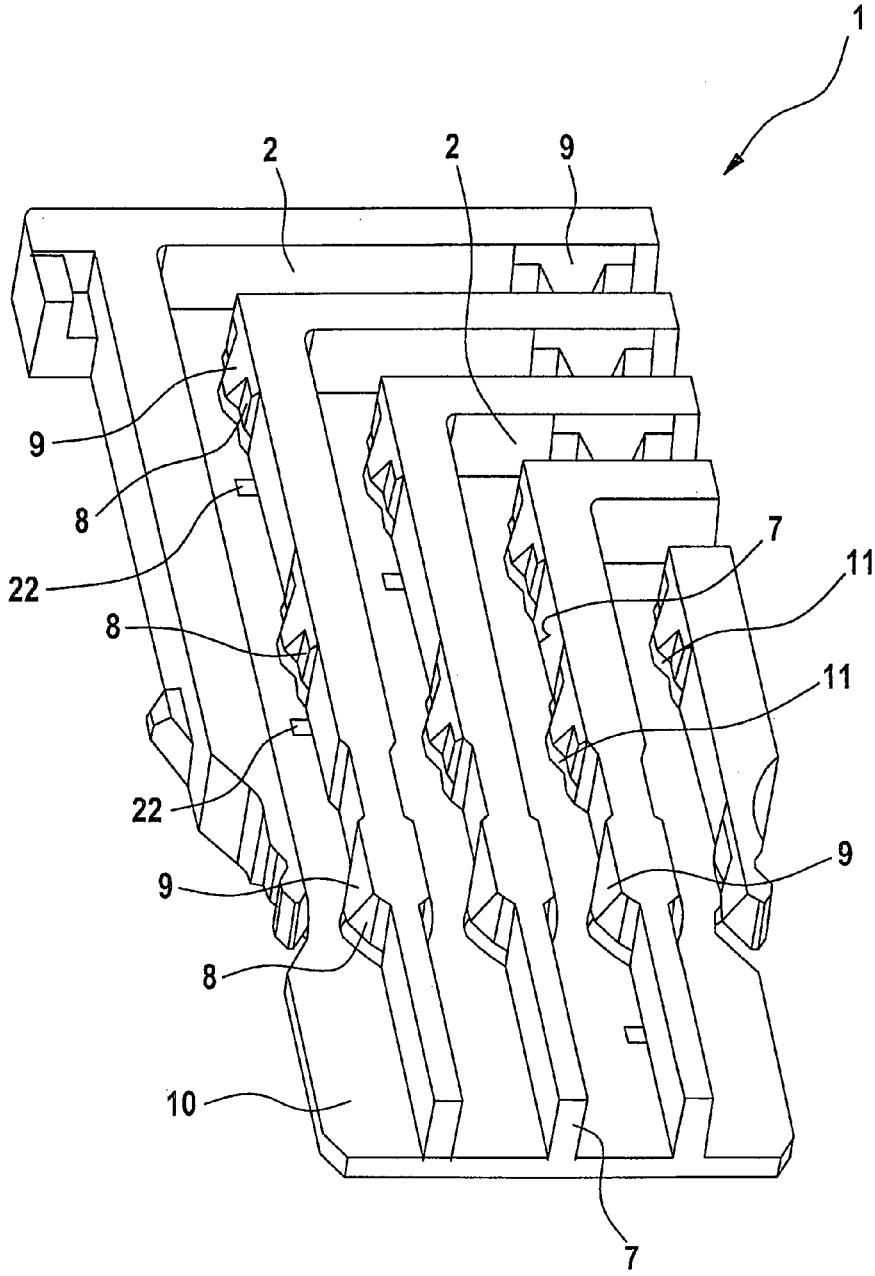
Figure 4:
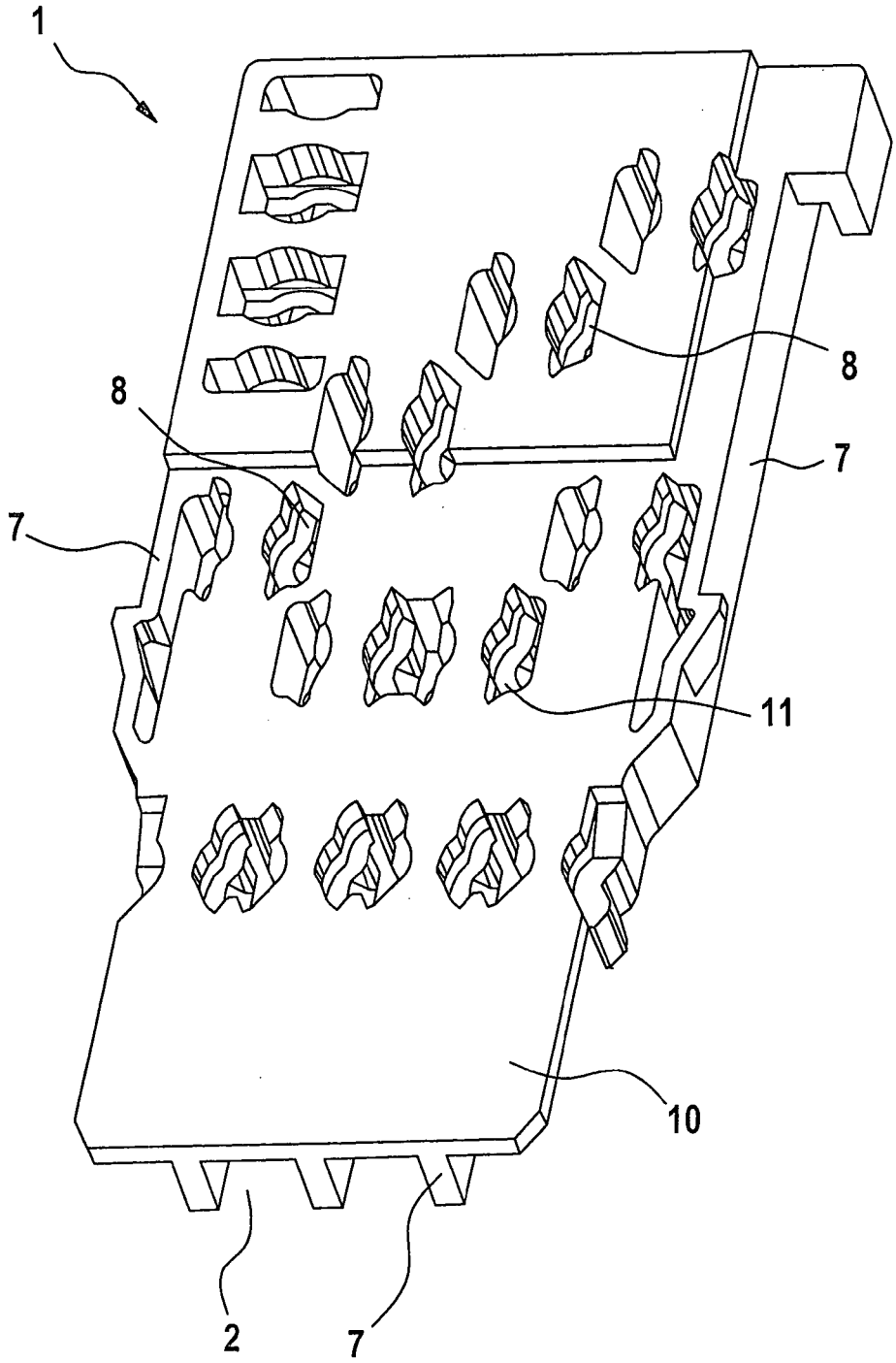

FIG. 2 shows the female multipole connector according to FIG. 1, in a view from the bottom;

FIG. 3 shows the basic body, without the contact springs laid in place, in a top view; and FIG. 4 shows the basic body according to FIG. 3 in a view from the bottom.

Figure 5:
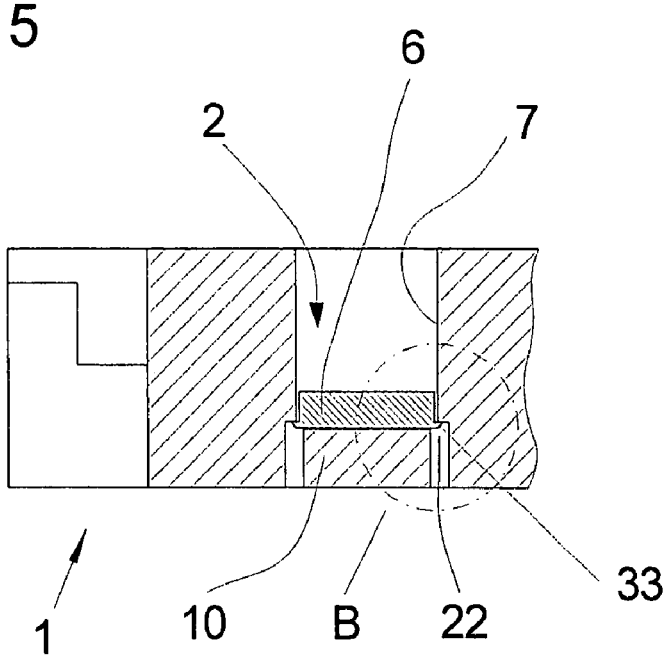
Figure 5:
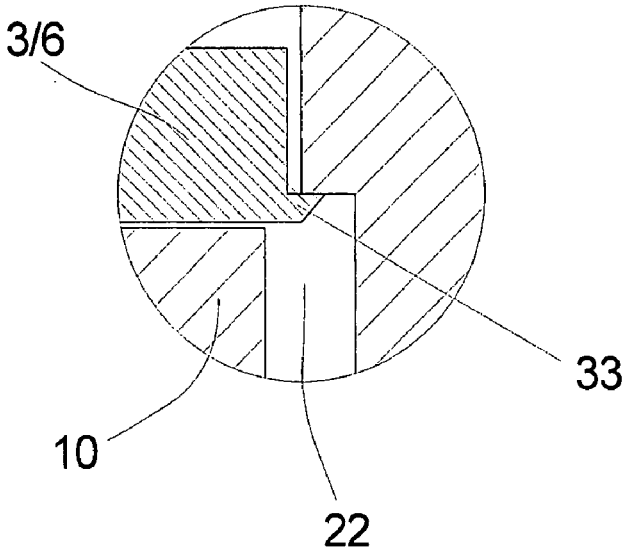

FIG. 5 shows a cross-sectional view through section V of the female multipole connector shown in FIG. 1, showing a detailed view of an undercut and a catch projection.

DETAILED DESCRIPTION OF THE PREFERRED EMBODIMENT

Referring now in detail to the drawings, FIG. 1 shows a complete female multipole connector in a top view. It consists of a plate-shaped basic body 1, into which a plurality of parallel guide channels 2 has been molded. The female multipole connector, with other female multipole connectors lying in stack-like manner, and a multipole plug corresponding to this, not shown in greater detail, plus housing parts and shielding against interference radiation, not shown here, forms an angled plug-type connector, as they are used, for example, in computer technology, for releasably connecting circuit boards.

Accordingly, guide channels 2 are angled away at a right angle. Contact springs 3 are inserted into guide channels 2, so as not to become loose and in a mechanically rigid manner.

Contact springs 3 consist of well conductive sheet material for springs, for example hard copper sheet. They are punched and bent from a single piece, in automated equipment. At one end of contact spring 3, the actual contact spring has been formed in the machining process, here a two-arm contact spring 4 for the contact blades of the multipole plug. At the other, there is a solder connector, here an SMD solder connector 5 for soldering the plug-type connector onto a circuit board. The conductive track 6 of the contact spring 3 that connects the two connectors 4, 5 is bent at the same right angle as the guide channel 2 that is provided for it. Snap-in projections 8 are worked into the side walls 7 of guide channels 2, on both sides and in pairs. In the example, two to four pairs of snap-in projections 8 are provided, depending on the length of contact springs 3. When contact springs 3 are assembled during the assembly process, which preferably takes place fully automatically, they snap behind snap-in projections 8 by way of snap-in slants 9 of snap-in projections 8. Elastic deformation of the contact springs 3 in the snap-in regions is forced to occur, until the end position has been reached when contact springs 3 snap in behind snap-in projections 8, and contact springs 3 that were elastically deformed in the corresponding regions of the conductive tracks 6 make their deformation retroactive again.

Afterwards, contact springs 3 are connected with basic body 1 in mechanically rigid manner, by means of a direct snap connection, thereby making it possible to eliminate the usual cover plate without replacing it.

In FIG. 2, the complete female multipole connector can be seen from the rear. Passages 11 in the region of the snap-in projections 8 can be seen in bottom 10 of basic body 1, as can the snap-in projections 8 themselves, behind which the contact springs 3 have snapped in. The SMD solder connectors are referred to as 5.

In FIG. 3, the basic body 1 can be seen in a top view, and in FIG. 4, in a bottom view, without contact springs 3, in each instance. Snap-in projections 8, disposed in pairs, and passages 11 can be clearly seen. These passages 11, provided there according to the invention, are primarily advantageous for the production of snap-in projections 8. They facilitate the formation of snap-in projections 8 in the compression-molding die. However, they can also be used to check that the contact springs 3 have completely snapped in, for example by way of a corresponding electrical needle matrix. Furthermore, the body sections of basic body 1, in other words side wall 7 that is disposed between two adjacent guide channels 2, in each instance, are intentionally weakened at these points. As a result, side wall 7 is given an increased elastic behavior precisely at those locations where snap-in projections 8 are provided. When a contact spring 3 is laid into a guide channel 2, this allows improved escape and snap-back of snap-in projections 8.

In one variant, the contact springs themselves can form catch projections 33, in that catch nubs or catch projections 33 are molded on, which snap in behind corresponding undercuts 22 of the guide channels. In this way, the snap-in projections on the guide channels can be eliminated, and the joining process is facilitated by means of better guidance of the contact springs in the flat-walled guide channels. Engagement slots in the bottom region of the guide channels for the nubs of the contact springs are sufficient.

All of the characteristics mentioned in the above specification, as well as all of the characteristics that can be derived from the drawings alone are furthermore integral parts of the invention, even if they have not been particularly emphasized and mentioned in the claims.

The invention is not restricted to the exemplary embodiment, but rather can be varied in many different ways, within the scope of the disclosure.

REFERENCE SYMBOLS

1 basic body
2 guide channels
3 contact springs
4 two-arm contact spring
5 SMD solder connectors
6 conductive tracks
7 side walls
8 snap-in projections
9 snap-in slants
10 bottom
11 passages
22 undercut
33 catch projection
34 tab
35 rivet-like pin

What is claimed is:

1. A female multipole connector for electric plug-type connectors, comprising:

a plate-shaped basic body having guide channels, said guide channels having side walls with snap-in contours; and contact springs directly mechanically and rigidly connected with said basic body by a direct snap connection to have an elastic positive lock with the basic body, said contact springs being disposed in said guide channels, so as not to become loose, wherein said snap-in contours on said side walls of said guide channels comprise snap-in projections with snap-in slants, behind which the contact springs snap in, at intervals; and wherein said contact springs have such spring properties, in a section of conductive track, that said contact springs deform elastically when pressed behind the snap-in projections of the guide channels, and spring back elastically again when an end position has been reached, by snapping in behind the snap-in projections.

2. A female multipole connector according to claim 1, wherein the snap-in projections are disposed on one side or both sides of the guide channels, distributed over a length of the guide channels.

3. A female multipole connector according to claim 2, wherein the snap-in projections are disposed on both sides of the guide channels, in pairs.

4. A female multipole connector according to claim 1, wherein the contact springs carry catch projections that elastically snap in behind corresponding bottom-side undercuts in the guide channels.

5. A female multipole connector according to claim 1, wherein the contact springs are connected with the basic body by a plastic positive lock.

6. A female multipole connector according to claim 1, further comprising a tab connection between the contact springs and a back of the basic body, wherein tabs on the contact springs are inserted through passages in the basic body and bent around against the bottom of the basic body.

7. A female multipole connector according to claim 1, wherein the contact springs are fixed in place in the basic body by thermally partially plasticized side walls of the guide channels, or attached in the guide channels by rivet-like pins.

8. A female multipole connector according to claim 1, further comprising at least one passage in a region of the snap-in projections on the side walls, in a bottom of the basic body.

9. A female multipole connector according to claim 8, wherein each of said at least one passage is disposed under a snap-in projection.

10. Female multipole connector according to claim 8, wherein each passage is disposed under a snap-in projection, and wherein a lengthwise expanse of the passage is greater than a lengthwise expanse of the snap-in projection.

11. A female multipole connector according to claim 8, wherein said at least one passage is disposed under two end regions of each snap-in projection.

* * * * *